US007690392B1

(12) United States Patent
Sarkiss

(10) Patent No.: US 7,690,392 B1
(45) Date of Patent: Apr. 6, 2010

(54) CARTRIDGE AND VALVE DEVICE FOR MIXING EFFLUENT WITH LIQUID OR SOLID USING VENTURI

(76) Inventor: Vahe Sarkiss, 29121 Corales Pl., Canyon Country, CA (US) 91387

( * ) Notice: Subject to any disclaimer, the term of this patent is extended or adjusted under 35 U.S.C. 154(b) by 902 days.

(21) Appl. No.: 11/367,680

(22) Filed: Mar. 3, 2006

(51) Int. Cl.
*E03D 9/03* (2006.01)

(52) U.S. Cl. ..... 137/205.5; 137/268; 239/310; 422/282

(58) Field of Classification Search ..... 137/205.5, 137/268, 594, 599.11, 599.12, 599.14, 599.15, 137/613; 222/3, 5, 85, 89, 424; 251/149.6; 285/321; 239/309, 310, 407; 422/282; 604/272
See application file for complete search history.

(56) References Cited

U.S. PATENT DOCUMENTS 825,173 A * 7/1906 Ansley ..... 222/83.5
1,324,206 A * 12/1919 Nickell ..... 222/83
1,855,323 A 4/1932 Sirch
2,573,576 A * 10/1951 Klumb ..... 422/266
2,737,199 A * 3/1956 Ingram ..... 137/587
3,118,462 A 1/1964 Pannutti
3,943,960 A 3/1976 Syrenne
3,968,932 A 7/1976 Kimmell
3,974,847 A 8/1976 Hodges
4,026,673 A 5/1977 Russo
4,115,270 A 9/1978 Phillips
4,212,373 A * 7/1980 Scragg ..... 222/89
4,250,910 A * 2/1981 King ..... 137/268
4,250,911 A 2/1981 Kratz
4,333,493 A 6/1982 Beiswenger et al.
4,555,347 A 11/1985 O'Dowd et al.
4,881,568 A * 11/1989 Ho ..... 137/268
4,907,618 A * 3/1990 Ho ..... 137/268
4,971,091 A * 11/1990 Ho ..... 137/268
5,104,003 A * 4/1992 Stecoza ..... 222/83.5
RE33,969 E * 6/1992 Richter ..... 137/594
5,178,181 A 1/1993 Craig (Continued)

OTHER PUBLICATIONS

Excerpts from www.growersupply.com; B&T Grower Supply, Inc.; Non-Electric Dosatron Injectors; 2 pages; printed Apr. 2, 2004.

(Continued)

*Primary Examiner*—Stephen Hepperle
*Assistant Examiner*—Craig Price
(74) *Attorney, Agent, or Firm*—Law Offices of David L. Hoffman

(57) ABSTRACT

A mixing body for diverting a portion of a liquid, e.g., water flow, into a cartridge of fertilizers, fungicides, hormones, pesticides or the like to form effluent. The effluent is reintroduced to the water flow and goes to a downstream sprinkler or application system. The cartridge, which may contain liquid concentrate, is inserted into the mixing body, which has inlet and outlet one way valves that puncture a sealing layer of the cartridge. The diluted effluent exits through the outlet one way valve and is thus delivered to the irrigation system. The amount of effluent can be regulated by a needle valve that controls the amount of effluent exiting the manifold. The mixing body has a locking system to securely hold the cartridge in place. There is also a plate to protect a user from the sharp inlet and outlet valves when the cartridge is removed.

20 Claims, 6 Drawing Sheets

U.S. PATENT DOCUMENTS

| | | | | |
|---|---|---|---|---|
| 5,246,168 | A | 9/1993 | Williams | |
| 5,303,729 | A | 4/1994 | DeMarco | |
| 5,323,808 | A * | 6/1994 | Shimizu | 137/594 |
| 5,364,030 | A | 11/1994 | Murdock et al. | |
| 5,653,261 | A | 8/1997 | Dalhart et al. | |
| 5,666,987 | A | 9/1997 | Combs | |
| 6,206,046 | B1 | 3/2001 | Finley | |
| 6,314,979 | B1 * | 11/2001 | Lips | 137/205.5 |
| 6,745,998 | B2 * | 6/2004 | Doyle | 251/149.6 |
| 6,908,119 | B2 * | 6/2005 | Murken | 285/305 |
| 6,918,952 | B2 * | 7/2005 | van der Maas | 96/117.5 |
| 2007/0113892 | A1 * | 5/2007 | Chiriac et al. | 137/205.5 |

OTHER PUBLICATIONS

Excerpts from www.growersupply.com; B&T Grower Supply, Inc.; 11 GPM Dosatron DI 16; 2 pages; printed Apr. 2, 2004.

Premier Distributors; 2004 Law Sprinklers Landscape Lighting; 4 pages; printed Apr. 2, 2004.

Excerpts and Product Info. from www.fertigationdirect.com; Fertigation Injectors—Factory Direct!, FD100 Injector Specifications, How to Fertigate; 17 pages; printed Apr. 1, 2004.

Excerpts from www.fertigator.com; Home page; 2 pages; printed Sep. 12, 2005.

Excerpts from www.fertigator.com; FertiPro Controllers; 6 pages; printed Sep. 12, 2005.

Excerpts from www.fertigator.com; Choose the Right Product; 4 pages; printed Sep. 12, 2005.

"Fertigation," web excerpt dated Apr. 2, 2004, by Premier Distributers, Clinton Township, MI, 1 page.

Ortho; Dial n Spray; product label printed Apr. 2004; 2 pages.

Excerpts printed from www.Rittenhouse.ca; EZ-Flo Fertigation Injector; 10 pages; printed Apr. 1, 2004.

Excerpts printed from www.Rittenhouse.ca; Dosatron Fertilizer Injectors; 6 pages; printed Apr. 1, 2004.

Excerpts printed from www.Rittenhouse.ca; TP44C Injection Stem Parts; 3 pages; printed Apr. 1, 2004.

Excerpts printed from www.amiad.com; Fertigation & Accessories; 1 page; printed Apr. 1, 2004.

Excerpts printed from www.turffeeding.com; Landscape Model 700; 3 pages; printed Apr. 1, 2004.

Excerpts printed from www.turffeeding.com; Landscape Model 500; 2 pages; printed Apr. 1, 2004.

Excerpt printed from www.turffeeding.com; The Fertigation Leader; Turf Feeding Systems; 1 page; copyright 2003-2004.

Excerpts printed from www.turffeeding.com; Landcape Model 300; 1 page; printed Apr. 1, 2004.

Excerpts printed from www.turffeeding.com; Nutrient Injector Model 1000; 3 pages; printed Apr. 1, 2004.

* cited by examiner

CARTRIDGE AND VALVE DEVICE FOR MIXING EFFLUENT WITH LIQUID OR SOLID USING VENTURI

BACKGROUND OF THE INVENTION

1. Field of the Invention

The present invention relates to a device for mixing effluent with a liquid or powder using a venturi, and to the mixing device having needle valves which pierce a membrane of a cartridge system for the liquid or powder.

2. Description of the Related Art

For quite some time, the concept of a venturi has been used to mix effluent liquid with a material such as fertilizer, fungicide, plant food, or pesticide. For example, mixing a concentrated powder or granular form of fertilizer has been done. Typically, there is a plastic canister of the fertilizer, insecticide or weed killer in concentrated form, with a spraying nozzle on the top. The nozzle is at one end of a conduit, and at the other end is a threaded hose receptacle. A user loads the canister, or it comes loaded, and threads the hose to the conduit in the receptacle. There is usually an on/off switch which would be switched on and some of the water flows into the canister, mixing with concentrate. After being mixed, the water returns to the main flow and is sprayed out of the nozzle.

An example of a venturi device is shown in U.S. Pat. No. 5,178,181 to Craig, U.S. Pat. No. 3,974,847 to Hodges, U.S. Pat. No. 4,250,910 to King, and U.S. Pat. No. 5,303,729 to DeMarco.

More recently, devices which use ventui principles have been employed for fertilization through connection to an irrigation system, and have been called "fertigation" devices. One such device uses a re-fillable reservoir installed before anti-siphon valves. As known to the inventor, to date all these types of devices are electronically controlled to select between "bypass" (normal watering) and "use" (fertilizing) positions.

An example of a cartridge feeder system is shown in U.S. Pat. No. 4,333,493 to Beiswenger et al. This system is manual in that you must connect the hose, and you must hold the hose and canister to spray wherever needed or desired. Moreover, many systems suffer from practical problems such as how to connect a canister or container to the system without spillage.

SUMMARY OF THE INVENTION

In one embodiment, there is a mixing device that has a mixing body for mixing a concentrated material such as a concentrated liquid or solid (e.g., in powder or granular form) into a diverted portion of a main liquid (e.g., water) flow. The concentrate is provided in a cartridge having a sealing membrane over its mouth. The cartridge is preferably disposable.

The mixing body has an inlet and an outlet opening for entry and exit of a main fluid flow along a main fluid flow passage for a secondary flow. There is a receptacle in which a cartridge having concentrate may be placed. An inlet valve and an outlet valve are formed as needle valves which have tips for puncturing the membrane. The inlet valve communicates the secondary passage with an interior of the cartridge and the outlet valve communicates the interior of the cartridge with a third flow passage. The third flow passage communicates with the main flow passage.

Fluid from the main flow passes through the second passage to the cartridge to mix with the concentrate, then the flow mixed with the concentrate passes out of the cartridge via the outlet valve, through the third passage, and is reintroduced to the main flow, there by mixing the concentrate into the main flow.

The fluid with concentrate may be distributed by an irrigation system. The system can be used to fertilize, to distribute pesticide, or other purposes.

DESCRIPTION OF THE PREFERRED EMBODIMENT(S)

Figure 1:
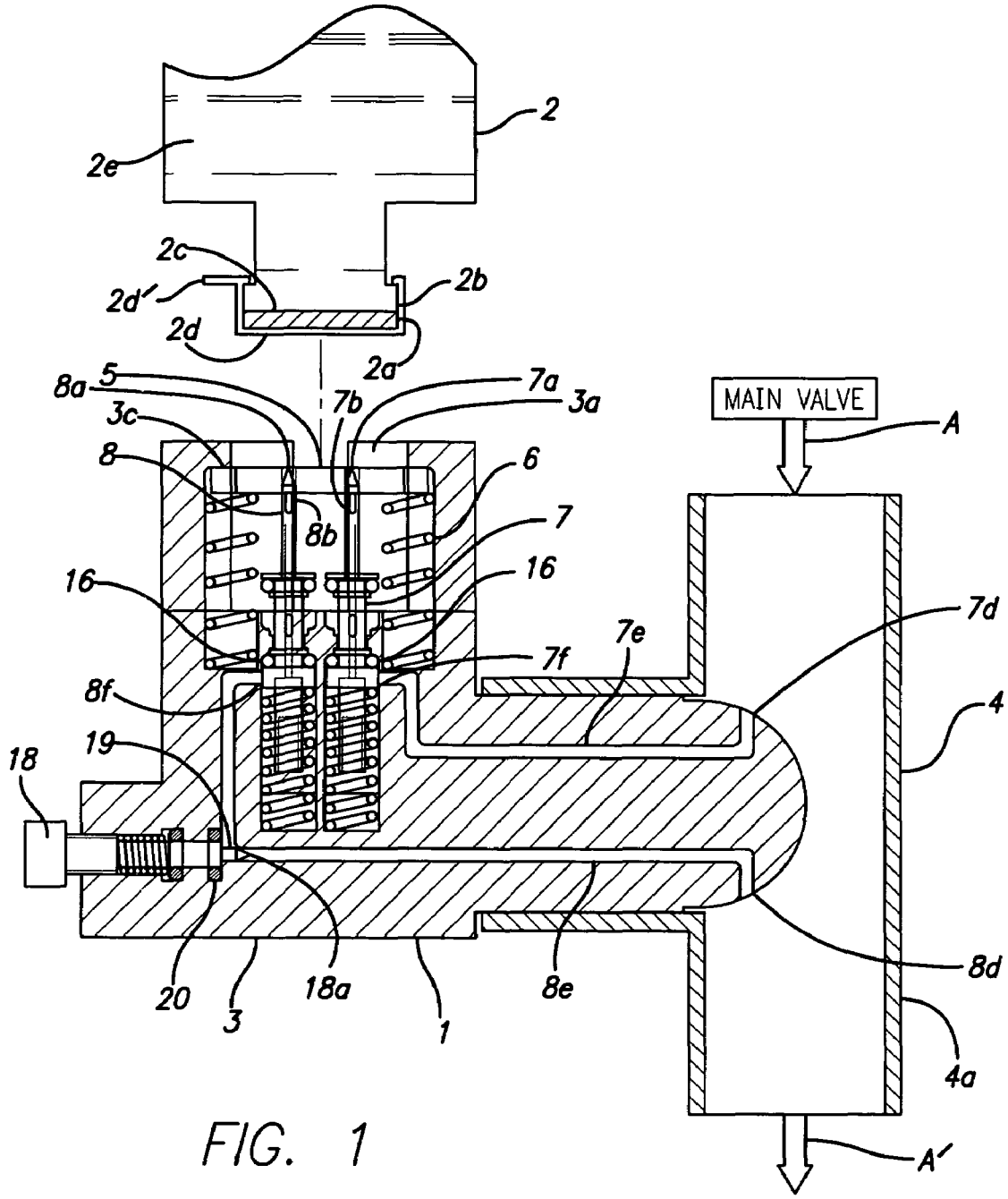
FIG. 1 is a vertical sectional view of a device according to a preferred embodiment of the invention installed in a main flow line, without a cartridge being installed.
Figure 2:
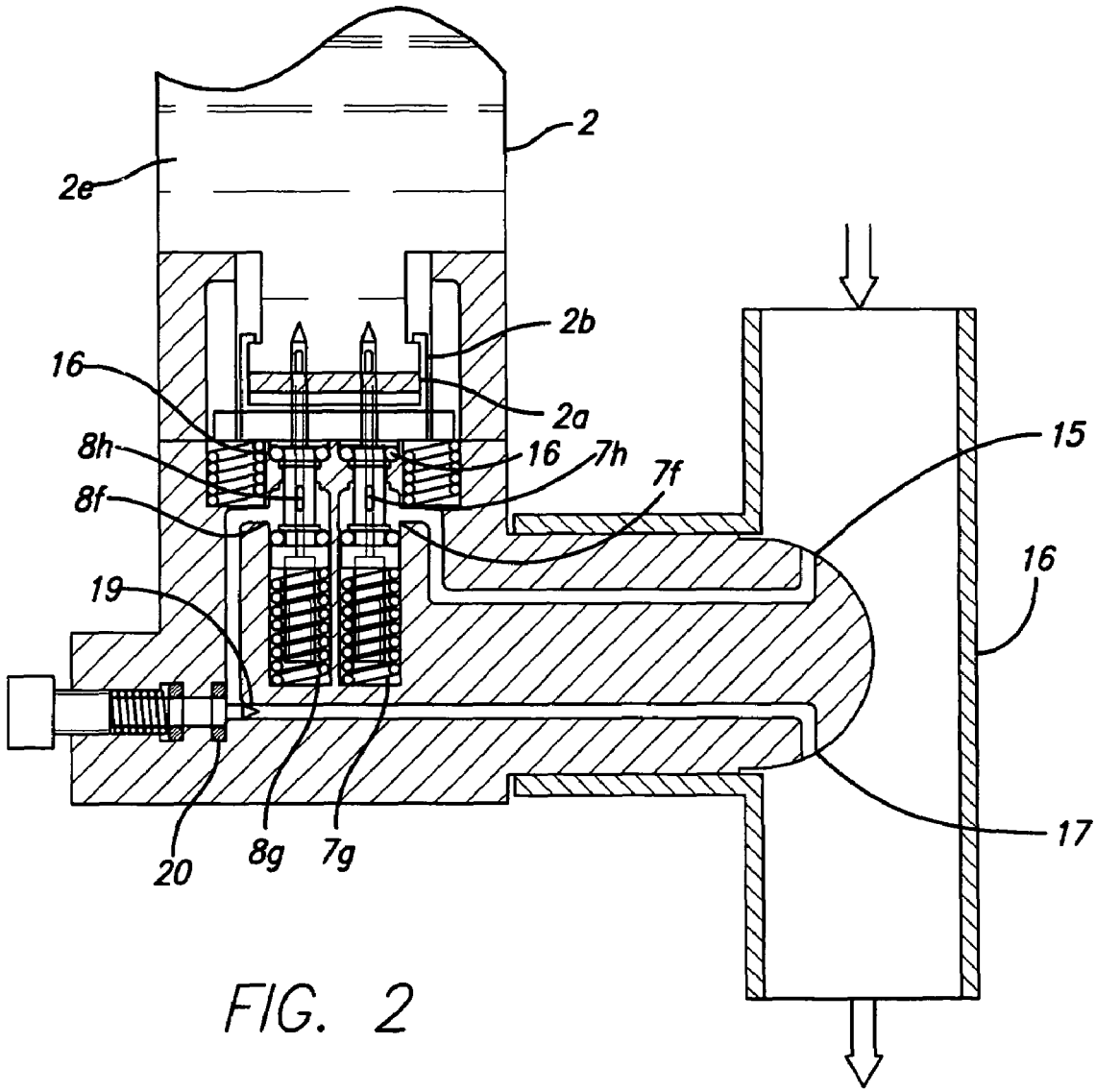
FIG. 2 is a view similar to FIG. 1 with the cartridge installed and in the use position.

With reference to FIGS. 1-2, in one embodiment a mixing device 1 communicates and mixes concentrate from a cartridge bottle 2 with some liquid from a main flow A through a T-fitting 4*a*. Some of the liquid is diverted through mixing body 3 into a cartridge 2 then back to T-fitting 4*a*.

FIG. 1 shows the mixing body 3 before the cartridge bottle 2 is inserted therein. FIG. 2 shows the mixing body 3 after the cartridge bottle is inserted therein.

When assembled cartridge bottle 2 is inserted into the mixing body 3 at a port 3*a*. A membrane 2*c* covers the mouth 2*a* and is held in place by annular sidewall 2*b*. A peel-away cover 2*d* protects the membrane, and is opened by the user by pulling a tab 2*d*'. A protective plate 5 is disposed in mixing body 3 and is spring biased by spring 6 outward. The plate 5 covers sharp ends 7*a*, 8*a* of two needle valves 7, 8. The sharp ends of the one way needle valves 7, 8 will puncture the cartridge membrane 2*c* (FIG. 2) exposing the one way valves to concentrate 2*e*. The bottle has a mouth 2*a* that passes by walls 3*c* of the mixing body port 3*a*. When there is no cartridge in the device 1, as explained more below, springs keep needle valves 7, 8 in a position where no water can flow.

Figure 7:
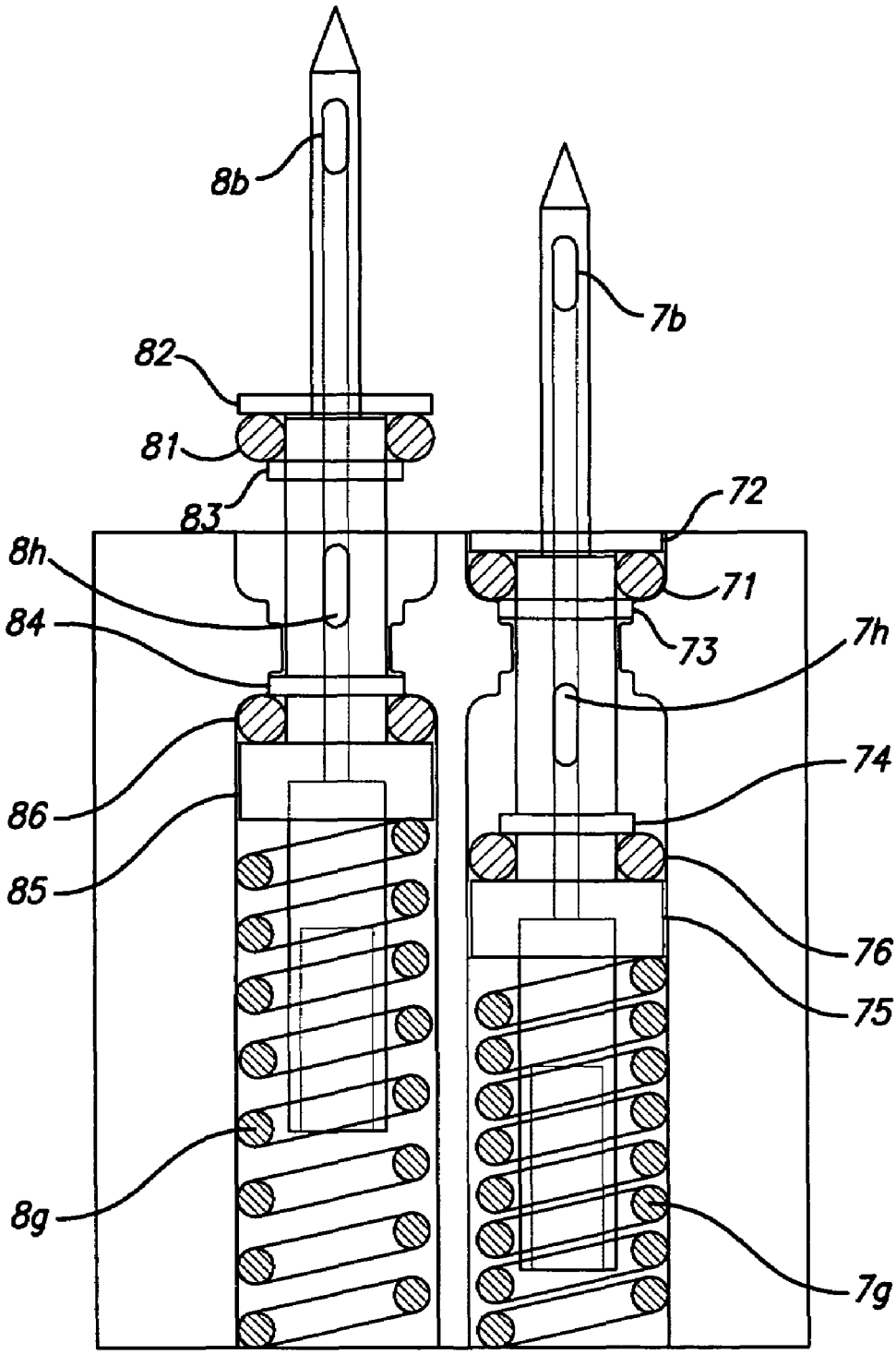
FIG. 7 is an enlarged view of spring loaded needle valves of FIGS. 1 and 2, a left side of FIG. 7 showing a needle valve in a nonengaged position as in FIG. 1, and a right side of FIG. 7 showing a needle valve in an engaged position as in FIG. 2.

More specifically, as shown in FIG. 1, and in the needle valve 8 on the left side of FIG. 7, spring 8*g* keeps the needle valve's opening 8*h* out of alignment with outlet path opening 8*f*, so no liquid can flow out without a cartridge. O-rings 81, 86 maintain a seal as needed. Similarly, spring 7*g* keeps opening 7*h* in the position of FIG. 1 and thus out of alignment with outlet 7*f* of inlet path 7*e* so no liquid can pass through valve 7 and thus cannot come out of opening 7*b* when the cartridge is not in place. O-rings 71, 76 maintain a seal as needed.

When the cartridge bottle 2 is inserted into the mixing body 3, as shown in FIG. 2, sidewalls 2*b* of mouth 2*a* will push down on plate 5, which in turn compresses springs 6 into corresponding recesses 16 in the mixing body 3, and also presses down on shoulders 72 and 82 of the needle valves, compressing the springs 7*g*, 8*g* (see FIG. 7, right side showing valve 7 in the actuated or engaged position). Therefore, opening 7*h* aligns with opening 7*f*, thereby allowing fluid to flow into the cartridge bottle and mix with the contents. The fluid will then flow out of the cartridge via needle valve opening 8*b*, and out of the needle valve via opening 8*h*, which is now aligned with the outlet path opening 8*f*.

Figure 3:
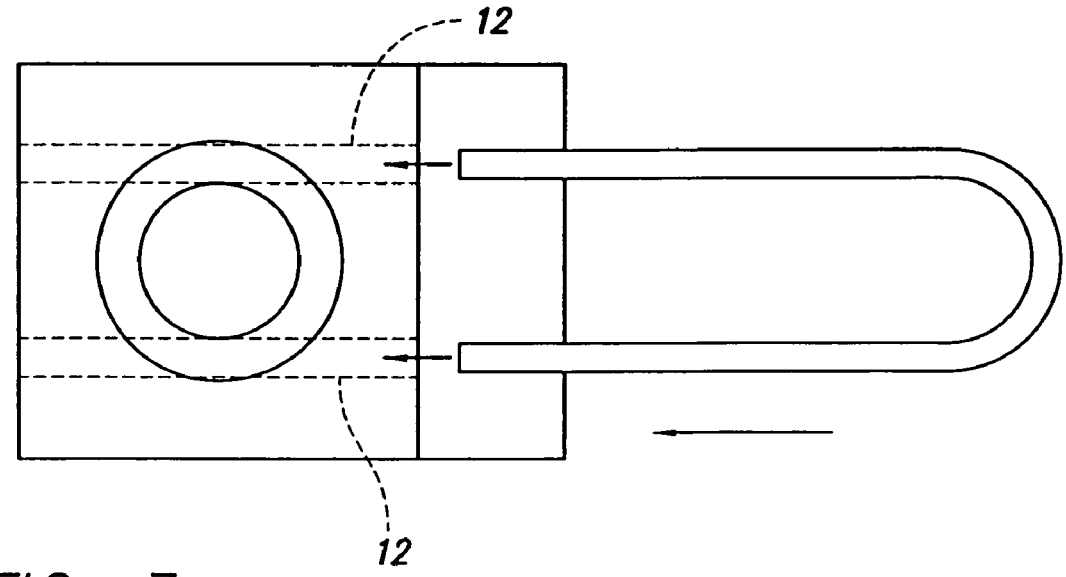
FIG. 3 is a top view of a portion of the mixing device of FIG. 1, using an alternate embodiment of a locking mechanism for the cartridge.
Figure 4:
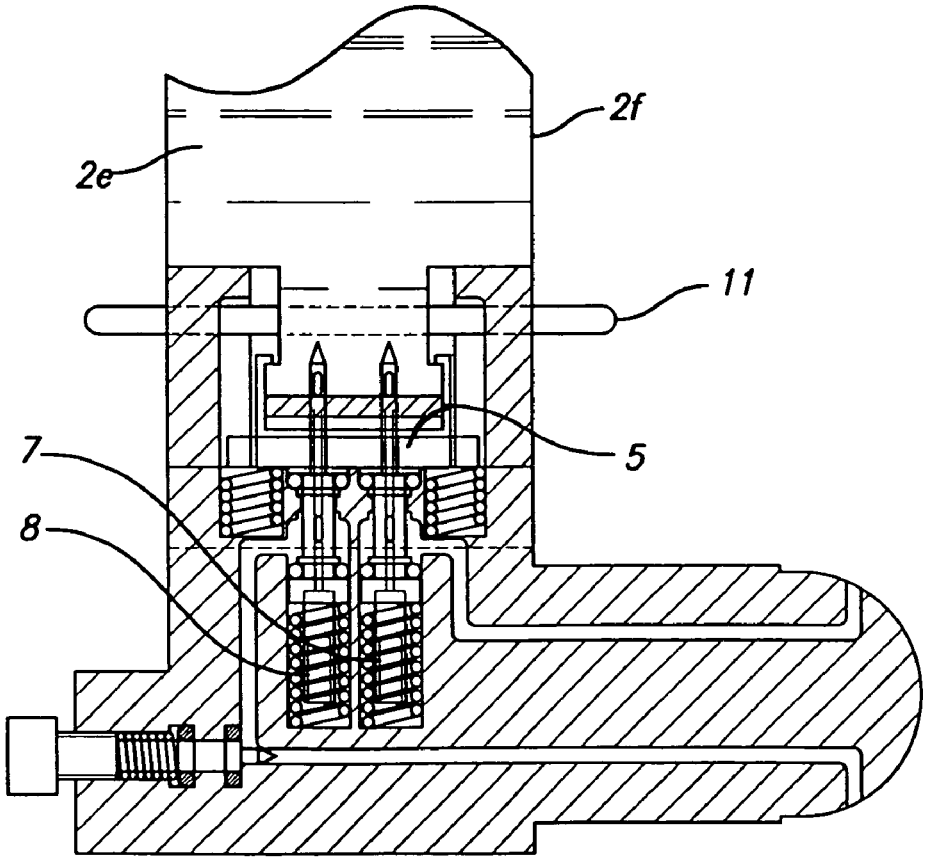
FIG. 4 is a partial side view of the mixing device with a further alternate locking mechanism for the cartridge.

The cartridge bottle 2 may alternatively be secured in place by a body clip 11 that is inserted through the mixing body perpendicular to the concentrate bottle via through-holes 12 in the mixing body, as shown in FIG. 3. The inside diameter of U-clip 11 is equal to the bottle neck diameter thus not allowing a modified bottle 2*f* to move past it unless U-clip 11 is removed. (See FIGS. 3 and 4)

As water passes through the venturi coupling 4 (T-fitting 4*a*) it is forced through an opening 7*d* of an inlet passage 7*e* to needle valve 7, into the cartridge, through valve 8, and out opening 8*d*. (FIG. 2) In the cartridge, the liquid mixes with concentrate 2*e*. The one way inlet valve 7 allows inlet water to infiltrate the concentrate 2*e*. A positive seal is provided with the mixing body 3 due to the o-rings preventing leakage of effluent past the inlet one way valve 7 and outlet one way valve 8.

As the inlet liquid enters cartridge 2, concentrate and liquid mix form a liquid with diluted concentrate or an "enriched effluent." The enriched effluent is discharged through outlet one way valve 8 and its oval side opening 8*b* then along outlet passage 8*e* (or tube). Outlet one way valve 8 allows the effluent to infiltrate the mixing body.

As the enriched effluent evacuates outlet valve 8 it enters outlet tube 8*e* whereby, the enriched effluent enters the downstream main liquid flow became enriched main flow A'. Outlet flow may be regulated by a flow control valve 18 (FIGS. 1 and 2) as it passes through the outlet tube 8*e*.

Valve 18 is preferably a threaded spring loaded needle valve and effluent flow is controlled by the opening or closing of a valve stem 19, increasing or restricting enriched effluent flow that passes between valve stem 19 and passage 8*e*. O-rings 20 provide a positive seal between valve 18 and mixing body 3 to prevent leakage. Valve 18 may be placed as shown in FIG. 1 in dashed lines labeled 18*a* and in the closed position in solid lines in the open position.

Upon exiting valve 18, effluent flows through the outlet tube 8*e* towards the outlet 8*d* to venturi coupling 4. The effluent flow is also aided by the suction created by the downstream section of venturi coupling 4.

In the closed position of FIG. 1, an inlet opening 7*h* of valve 7 is above and out of alignment with an outlet end 7*f* of path 7*e*. In addition, an outlet opening 8*h* of valve 8 is above and out of alignment with an inlet end 8*f* of path 8*e*. That is, both valves 7 and 8 are normally closed due to springs 7*g* and 8*g* biasing an exterior or sleeve of needle valves 7, 8 in an upward (closed) position.

As shown in FIG. 2, when the mouth of the cartridge is inserted into the device body, the mouth pushes down on shoulders of the exterior or sleeve of the needle valves 7, 8, and therefore compresses springs 7*g*, 8*g* until the openings 7*h*, 8*h* of valves 7, 8 are aligned with the outlet end 7*f* and inlet end 8*f* of the paths 7*e*, 8*e*, respectively. Therefore, liquid will flow into the valve 7 and up into the cartridge, then down into the valve 8 and out the opening 8*h* into the path 8*e*.

Accordingly, inlet opening 7*d*, inlet passage 7*e*, inlet valve 7, outlet valve 8, outlet passage 8*e*, and outlet opening 8*d* are always in fluid communication when the cartridge is loaded into the device.

The effluent mixes with the main liquid flow A through coupling 4 and is disbursed into a flow A', which may lead to vegetation via sprinkler application.

Membrane 2*c* may be a rubberized membrane, similar to the membrane of a medicine vial, so that membrane 2*c* may be pierced by the needle valve ends, yet provide a seal around these ends. An example of such a material is PTFE.

To assist in holding springs 6 in place, recesses 16 in mixing body 3 receiving the lower ends of the springs 6 are preferred. The upper ends of springs 6 may optionally be attached to plate 5. Other mechanisms to hold the springs in place may be used.

Figure 5:
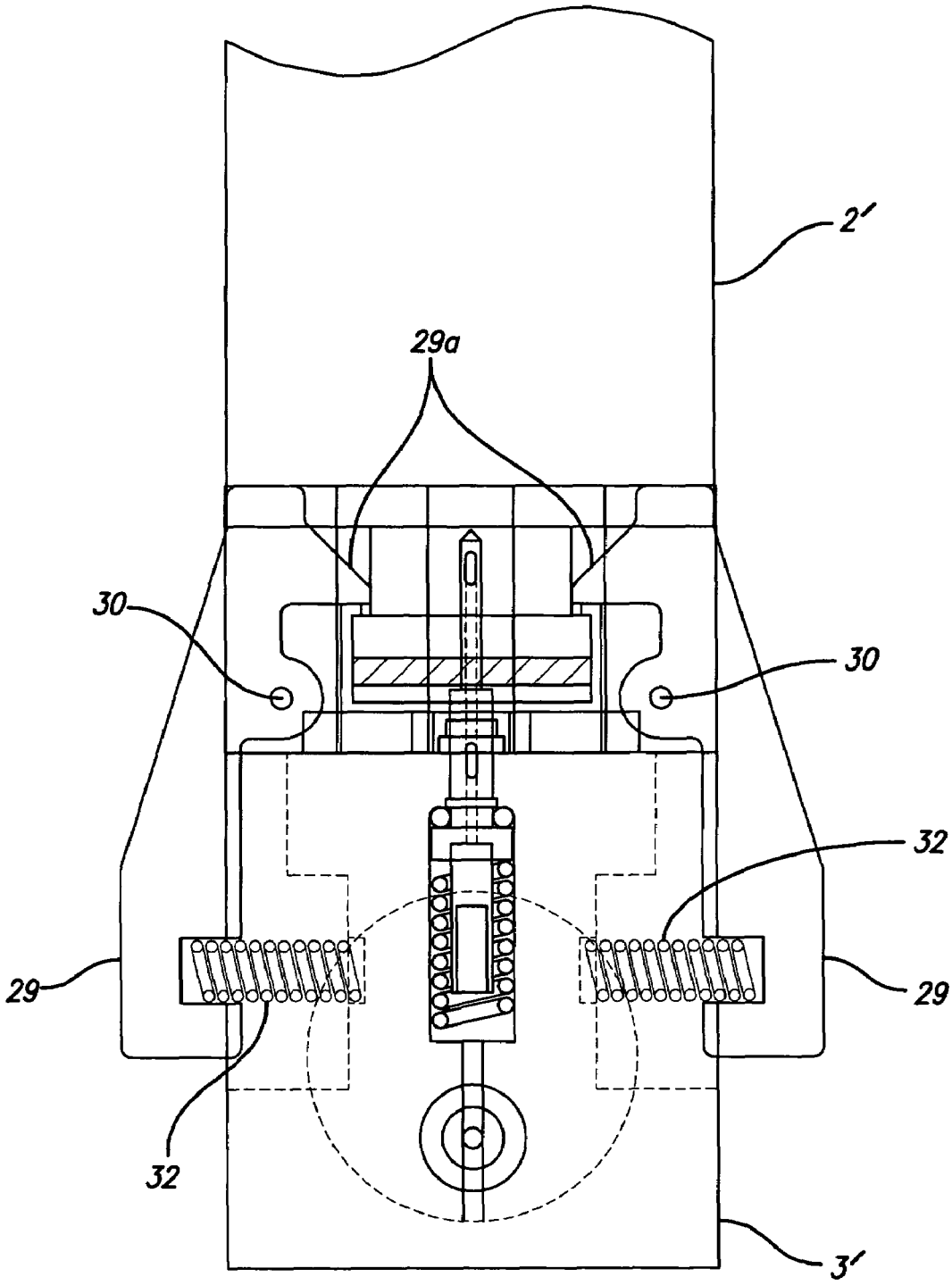
FIG. 5 is a back cutaway elevation view showing the mixing device with a cartridge locking mechanism according to another embodiment of the invention.

Other locking mechanisms for cartridge 2 and mixing body 3 may be used, other than clipping. For example, a spring loaded detent system may be used as shown in FIG. 5. Cartridge 2' has a mouth that has a membrane as before. To insert the mouth into mixing body 3', two arms 29 mounted on pivot pins 30 are pressed radially inward against the bias of two springs 32, which provides a clearance between protrusions 29*a* of the arms 29. The cartridge is inserted, membrane pierced, and arms released. The mouth of the bottle will then be held in place by protrusions 29*a* until removal is desired. Then the arms are pressed in again and the cartridge removed.

Figure 6:
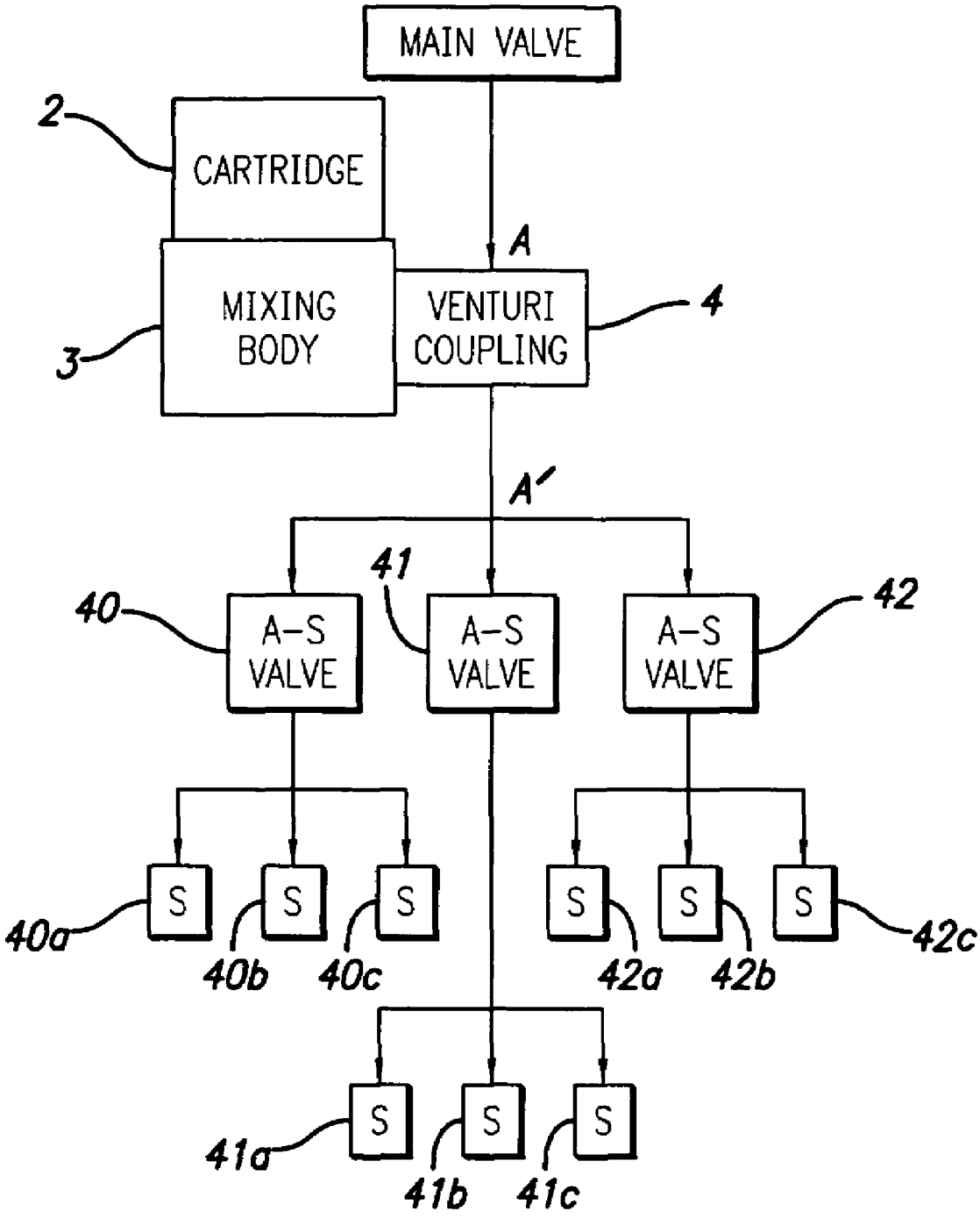
FIG. 6 is a schematic view of a sprinkler system with a mixing body cartridge and venturi coupling in accordance with a further embodiment of the invention.

As shown in FIG. 6, cartridge 2, body 3 and coupling 4 are in a sprinkler system having anti-siphon valves 40, 41, and 42, and each valve having associated sprinkler heads 40*a*, 40*b*, 40*c*; 41*a*, 41*b*, 41*c*; and 42*a*, 42*b*, 42*c*.

In use, the cartridge 2 is easy to install and remove, without a mess. Preferably it may be sold in single dose containers, or multiple doses. The cartridge may be removed between doses, or if empty, the cartridge allows flow without concentrate being mixed in. Removal of the cartridge is possible, as a positive seal is achieved.

The present structure avoids the need for a timer, electronic metering, or electronic controller. It does not preclude use of such devices, although they are omitted in the preferred embodiment. Other variations will be evident to those of ordinary skill in the art. The present structure also avoids the need for a bypass valve when there is no cartridge.

Although the invention has been described using specific terms, devices, and/or methods, such description is for illustrative purposes of the preferred embodiment(s) only. Changes may be made to the preferred embodiment(s) by those of ordinary skill in the art without departing from the scope of the present invention, which is set forth in the following claims. In addition, it should be understood that aspects of the preferred embodiment(s) generally may be interchanged in whole or in part.

What is claimed is:

1. A mixing device with a cartridge for mixing concentrate into a main flow, the device comprising:

(a) a cartridge containing a concentrate for mixing in water and having a membrane;

(b) a mixing body having an inlet for receiving diverted water from a main water flow an inlet passage communicating with the main water flow;

(c) a receptacle in the mixing body for slidably receiving and holding a cartridge having concentrate;

(d) an inlet valve for receiving the water flow from the inlet passage and for directing the flow into the cartridge through the membrane for mixing with the concentrate;

(e) an outlet valve in the mixing body extending through the membrane for receiving water mixed with concentrate from within the cartridge and communicating with an outlet passage; and (f) the outlet passage communicating with the main water flow at an outlet opening for reintroducing the diverted flow containing the concentrate into the main fluid flow, thereby mixing concentrate into the main flow, wherein the inlet and outlet valves each comprise a sharp tip for puncturing the membrane of the cartridge, wherein at the receptacle, the mixing device further comprises means for securing the cartridge, and wherein a portion of the mixing body containing the inlet and the outlet opening is disposed in the main flow to create venturi effect.

2. The mixing device of claim 1, wherein the means for securing comprises arms biased for securing the cartridge in response to pushing the cartridge into the receptacle.

3. The mixing device of claim 1, wherein the inlet and outlet valves each have a substantially conical tip, and an opening formed proximate a side of the tip.

4. The mixing device of claim 1, wherein the outlet passage communicates with the main flow passage downstream of a point where the inlet passage communicates with the main flow passage.

5. The mixing device of claim 1, wherein the inlet, inlet passage, inlet valve, outlet valve, outlet passage and outlet opening are always in fluid communication when the cartridge is in the receptacle.

6. The mixing device of claim 1, wherein the cartridge is disposable.

7. An irrigation system comprising a mixing device and a cartridge for mixing concentrate into a main water flow, the mixing device comprising:

(a) a cartridge containing a concentrate for mixing in water and having a membrane;

(b) a mixing body having an inlet for receiving diverted water from an inlet passage communicating with the main water flow;

(c) a receptacle in the mixing body for slidably receiving and holding the cartridge having the concentrate therein;

(d) an inlet valve for receiving the water from the inlet passage and for directing the water through the inlet valve;

(e) an outlet valve in the mixing body extending through the membrane for receiving water mixed with concentrate and communicating with an outlet passage;

(f) the outlet passage communicating with the main water flow at an outlet opening for reintroducing the diverted flow into the main water flow, thereby mixing concentrate into the main water flow; and (g) wherein the inlet and outlet valves each comprise a sharp tip for puncturing the membrane of the cartridge, and sealing the cartridge's membrane once the sharp tips penetrate the membrane, wherein there is also a means for securing the cartridge; wherein the irrigation system further comprises irrigation lines having a main irrigation line connected to manifold lines, each manifold line being connected to an anti-siphon valve, and each anti-siphon valve being connected to sprinkler lines and sprinkler heads, and the fitting being disposed in a main irrigation line wherein a portion of the mixing body is disposed in the main flow with the inlet upstream of the outlet opening to create a venturi effect.

8. The irrigation system of claim 7, wherein the inlet and outlet valves each have an opening formed proximate a side of the tip.

9. The irrigation system of claim 8, wherein the openings in the sides of the inlet and outlet valves are oblong.

10. A mixing device for use with a cartridge for mixing concentrate into a main flow, the device comprising:

(a) a mixing body having an inlet for receiving diverted fluid from a main fluid flow, and an inlet passage communicating with the main fluid flow;

(b) a receptacle in the mixing body in which a cartridge having concentrate and a membrane;

(c) an inlet valve for receiving the diverted fluid flow and for directing the flow through the valve for mixing with concentrate;

(d) an outlet valve in the mixing body extending through the membrane for receiving fluid mixed with concentrate from within the cartridge and communicating with an outlet passage;

(e) the outlet passage communicating with the main fluid flow at an outlet opening for reintroducing the diverted flow containing concentrate into the main fluid flow, thereby mixing concentrate into the main flow; and (f) wherein the inlet and outlet valves each having tips sufficiently sharp to pierce the membrane, and wherein the receptacle comprises means for protecting a user from the sharp tips of the inlet and outlet valves, wherein the means for protecting comprises a plate, biased to a position away from the sharp tips of the first and second valves, the plate having holes therein aligned with the sharp tips for allowing the sharp tips to extend therethrough when the plate is pressed inward to a use position with respect to the mixing body, so that the sharp tips extend through the holes in the plate.

11. The mixing device of claim 10, further comprising means for securing the cartridge to the mixing valve, with the cartridge mouth holding the plate in the use position.

12. The mixing device of claim 11, wherein the plate is biased by springs.

13. The mixing device of claim 10, wherein the outlet passage is adjustable for controlling flow to the outlet opening.

14. The mixing device of claim 10, wherein the receptacle comprises two openings in its side for ends of a U-shaped clip, for mechanically securing a container in the receptacle with the plate in its use position.

15. The mixing device of claim 11, wherein the membrane comprises PTFE.

16. The mixing device of claim 1, wherein the container has a membrane comprises PTFE.

17. The mixing device of claim 1, further comprising an adjustable valve disposed in the outlet passage for adjusting a flow rate through the mixing valve.

18. An irrigation system comprising:

a mixing device with a cartridge for mixing concentrate into a main flow, the device comprising:

(a) a fitting having first, second and third openings therein, and a main fluid flow through the first and second openings;

(b) a mixing body having a portion protruding into the fitting at the third opening, and having an inlet opening for receiving liquid diverted from the main flow, and having a first passage communicating with the inlet opening for receiving the diverted fluid flow;

(c) the cartridge having concentrate therein and a membrane for closing a mouth of the cartridge;

(d) a receptacle in the mixing body for slidably receiving and holding the cartridge;

(e) an inlet valve for receiving the diverted fluid flow and for directing the diverted flow into the cartridge through the membrane for mixing with concentrate;

(f) an outlet valve in the mixing body extending through the membrane for receiving diverted fluid having concentrate therein from within the cartridge and communicating with an outlet passage;

(g) the outlet passage communicating with the outlet valve and the diverted fluid having concentrate therein, and for reintroducing the diverted fluid having concentrate therein through an outlet opening into the main fluid flow, thereby mixing concentrate into the main flow;

(h) irrigation lines having a main irrigation line connected to manifold lines, each manifold line being connected to an anti-siphon valve, and each anti-siphon valve being connected to sprinkler lines and sprinkler heads, and the fitting being disposed in a main irrigation line; and (i) wherein the outlet passage is adjustable for controlling flow to the outlet opening.

19. The system of claim 18, wherein the cartridge contains one of herbicide, fungicide, and fertilizer in a concentrated form.

20. The irrigation system of claim 7, wherein the inlet, inlet passage, inlet valve, outlet valve, outlet passage and outlet opening are always in fluid communication when the cartridge is in the receptacle.

* * * * *